US006828521B2

(12) United States Patent
Stoving et al.

(10) Patent No.: US 6,828,521 B2
(45) Date of Patent: Dec. 7, 2004

(54) METHOD FOR INCREASING INSULATION LEVEL IN AN ENCAPSULATION

(75) Inventors: Paul N. Stoving, Oak Creek, WI (US); E. Fred Bestel, West Allis, WI (US); Charles Guenette, South Milwaukee, WI (US)

(73) Assignee: Cooper Industries, Inc., Houston, TX (US)

( * ) Notice: Subject to any disclaimer, the term of this patent is extended or adjusted under 35 U.S.C. 154(b) by 0 days.

(21) Appl. No.: 10/371,203

(22) Filed: Feb. 24, 2003

(65) Prior Publication Data

US 2004/0164053 A1 Aug. 26, 2004

(51) Int. Cl.[7] ..... H01H 33/66
(52) U.S. Cl. ..... 218/138; 218/134
(58) Field of Search ..... 218/7, 10, 42, 218/138, 118–122, 134, 139, 140, 143, 144, 153–155

(56) References Cited

U.S. PATENT DOCUMENTS

| | | | | | |
|---|---|---|---|---|---|
| 2,979,587 | A | * | 4/1961 | Jennings | 218/135 |
| 4,124,790 | A | * | 11/1978 | Kumbera et al. | 218/138 |
| 4,150,270 | A | * | 4/1979 | Zunick | 218/138 |
| 4,557,529 | A | * | 12/1985 | Cherry et al. | 218/118 |
| 5,597,992 | A | * | 1/1997 | Walker | 218/121 |
| 5,917,167 | A | * | 6/1999 | Bestel | 218/138 |
| 6,310,310 | B1 | * | 10/2001 | Wristen | 218/121 |

* cited by examiner

*Primary Examiner*—Elvin Enad
*Assistant Examiner*—M. Fishman
(74) *Attorney, Agent, or Firm*—Fish & Richardson P.C.

(57) ABSTRACT

A switchgear assembly includes a vacuum interrupter assembly having an internal switching contact. A conductive current exchange is in electrical contact with the switching contact, and the current exchange defines an internal chamber within the current exchange. A plug of non-conductive, compliant material has a first portion that extends into the internal chamber in contact with the current exchange. An insulative encapsulation surrounds the vacuum interrupter assembly, the current exchange, and the plug.

9 Claims, 2 Drawing Sheets

METHOD FOR INCREASING INSULATION LEVEL IN AN ENCAPSULATION

TECHNICAL FIELD

This disclosure relates to the field of electrical switchgear, and more particularly to methods of increasing insulation levels in a vacuum interrupter encapsulation.

BACKGROUND

High voltage vacuum current interrupters may be mounted or encapsulated at the upper end of an epoxy or porcelain structure or encapsulation that includes an internal chamber for supporting the interrupter and an operating rod.

The structure must withstand the application of high voltage to the switchgear. In particular, the structure is designed to reduce "tracking," which is the irreversible degradation of a surface of the structure due to the formation of carbonized or otherwise conductive paths. This may occur on any exposed surface of the structure, including the operating cavity, between the high potential to a frame below the encapsulation at ground potential, and may be due to either condensation or a build-up of surface contamination. The structure is also designed to prevent electrical arcing between the interrupter and the frame, and to prevent corona discharge caused by the ionization of air due to a high electric field gradient near a surface.

SUMMARY

In one general aspect, a switchgear assembly includes a vacuum interrupter assembly having an internal switching contact. A conductive current exchange is in electrical contact with the switching contact, and the current exchange defines an internal chamber within the current exchange. A plug of non-conductive, compliant material has a first portion that extends into the internal chamber and is positioned against the current exchange. An insulative encapsulation surrounds the vacuum interrupter assembly, the current exchange, and the plug.

Implementations may include one or more of the following features. For example, the plug may include a second portion that is positioned outside the internal chamber against the current exchange. The compliant material may include rubber. The switchgear assembly may include a shaft for moving the switching contact within the vacuum interrupter assembly A portion of the shaft may be located in the internal chamber, and the shaft may pass through a hole in the plug. At least a portion of the plug may be located between the shaft and the current exchange. The hole in the plug may have a cross-sectional area larger than the cross-sectional area of a portion of the shaft that passes through the hole such that the shaft does not contact the plug. The hole through the plug may be tapered from one side of the plug to another side of the plug.

In another general aspect, insulatively encapsulating an electrical switchgear assembly includes surrounding with a mold a vacuum interrupter assembly having an internal switching contact, a current exchange in electrical contact with the switching contact and defining an internal chamber, and a plug of non-conductive, compliant material, having a first portion that extends into the internal chamber against the current exchange. An insulative encapsulation is formed around the vacuum interrupter assembly, the current exchange, and the plug, and the mold is removed.

The details of one or more implementations are set forth in the accompanying drawings and the description below.

Other features will be apparent from the description and drawings, and from the claims.

DESCRIPTION OF DRAWINGS

Like reference symbols in the various drawings indicate like elements.

DETAILED DESCRIPTION

Figure 1:
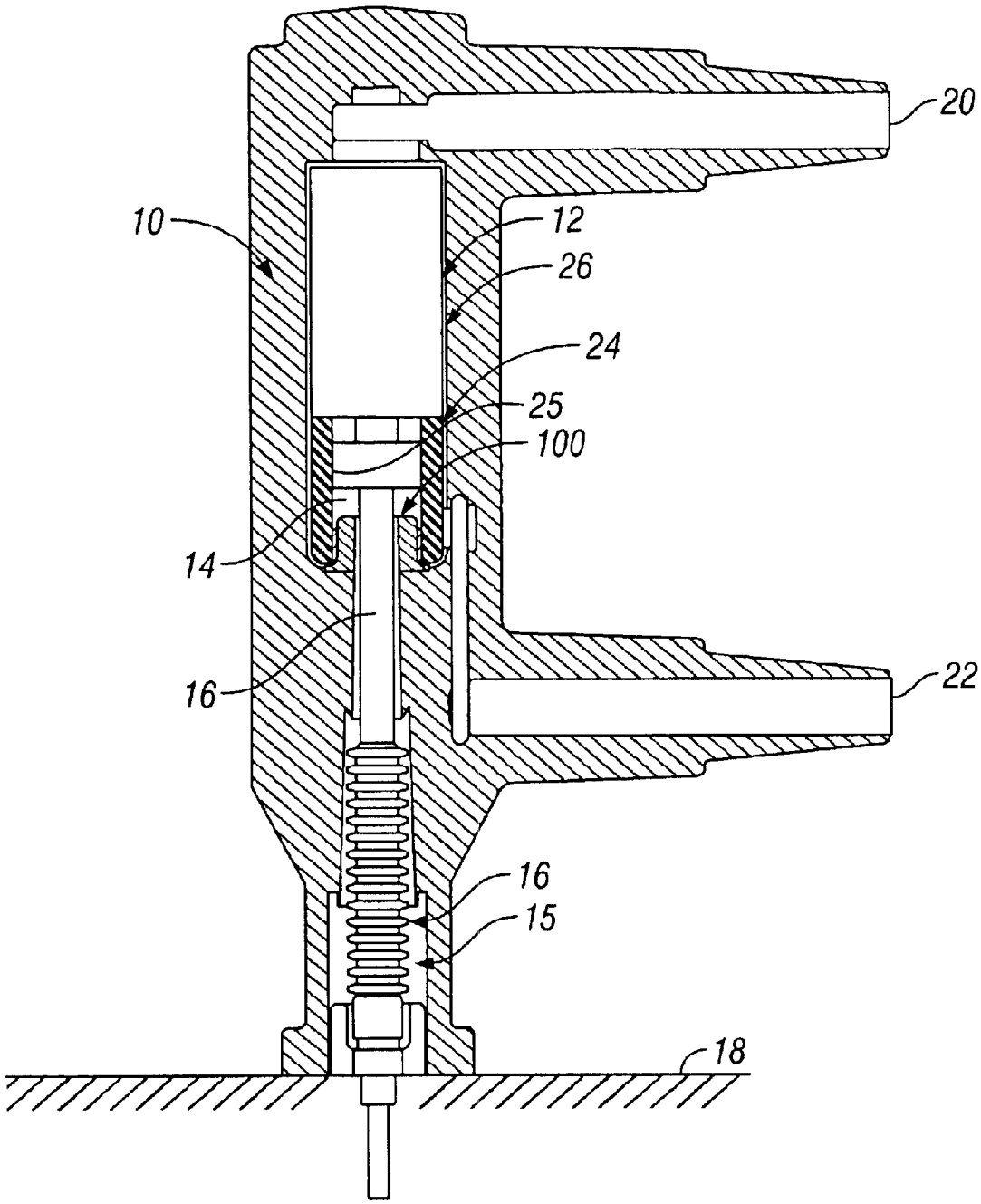
FIG. 1 is a cutaway side view of a vacuum interrupter encapsulation.

Referring to FIG. 1, an encapsulation 10 for an interrupter 12 includes an internal chamber 14. An operating rod 16 passes through the internal chamber 14. The operating rod 16 connects the interrupter 12 to an actuating mechanism (not shown) in the frame 18 upon which the encapsulation 10 is mounted.

The interrupter 12 is connected at terminals 20 and 22 such that an electrical current passes from terminal 20 to terminal 22 through interrupter 12 when the interrupter is in a closed position. In doing so, the current passes through an electrically conductive current exchange 24. In general, all electrically-conductive components, including terminals 20 and 22 and current exchange 24, are maintained at a high voltage. Current exchange 24 is annular and has a generally cylindrical interior surface 25 that defines the internal chamber 14. Operating rod 16 passes through an operating cavity 15 and connects to a movable piston within current exchange 24.

Encapsulation 10 may be cast from epoxy or any other suitable material capable of withstanding the mechanical, electrical, and thermal stresses that occur during use of interrupter 12. For example, a cycloaliphatic, prefilled, hot-curing, two-part epoxy may be used to form encapsulation 10.

Figure 2:
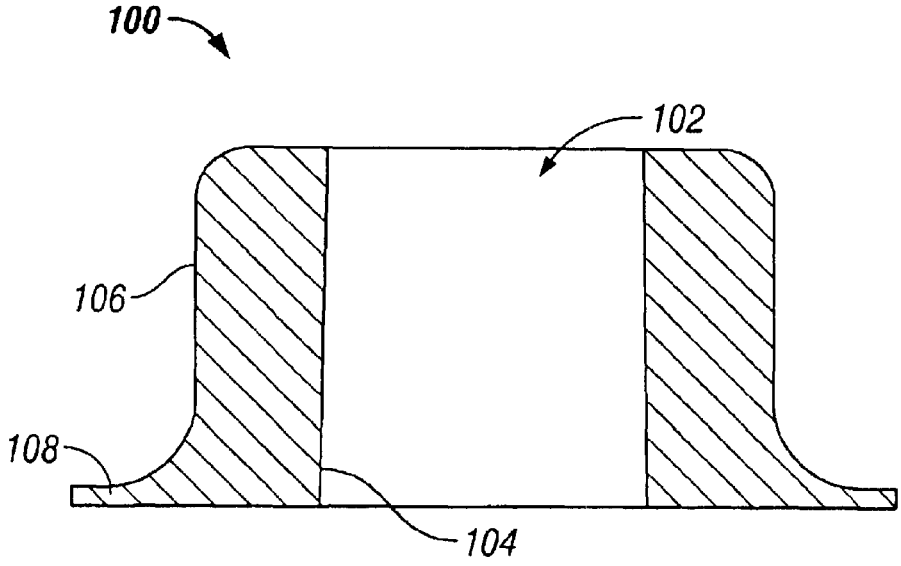
FIG. 2 is a cross-sectional side view of an insulating plug for use with a vacuum interrupter encapsulation.

Referring also to FIG. 2, an annular, generally cylindrical plug 100 of compliant non-conductive material is adapted for fitting around operating shaft 16 and extending into internal chamber 14. Plug 100 has a generally cylindrical hole 102 through which operating rod 16 passes without touching the inside surface 104 of the plug. Plug 100 has an outside surface 106 with a shape that is adapted for sealing against interior surface 25 of current exchange 24, and a flange 108 that is shaped to seal against the bottom surface of current exchange 24. The inside surface 104 of plug 100 may be slightly tapered, so that the diameter of the cylindrical hole 102 is slightly larger at the end closest to the flange 108 than at the end most distant from the flange 108. Plug 100 is made of silicone rubber or another suitable compliant material.

Figure 3:
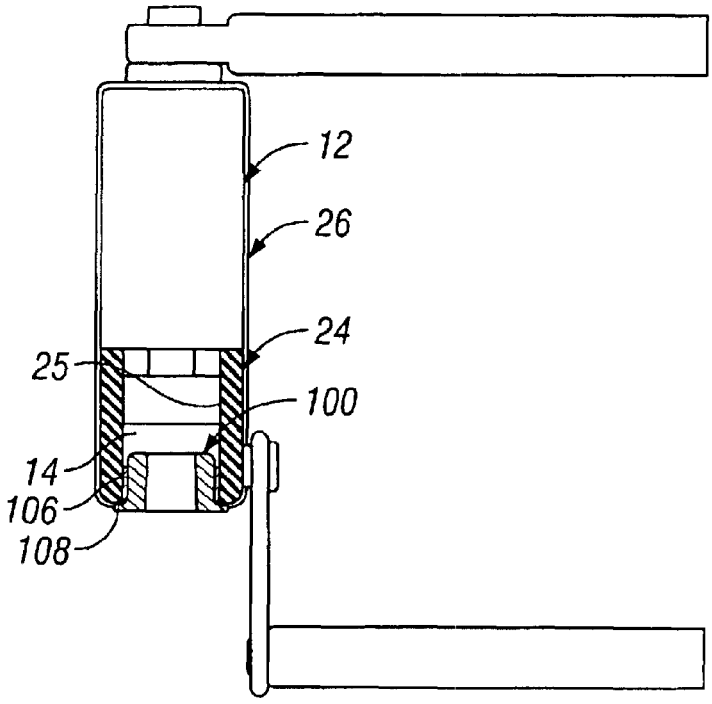
FIG. 3 is a cross-sectional side view of an insulating plug positioned within a vacuum interrupter.

FIG. 3 shows plug 100 in a sealing position such that outside surface 106 of the plug seals against interior surface 25 of current exchange 24, and flange 108 of the plug seals against the bottom surface of the current exchange. A layer of compliant material 26 (e.g., a stretched rubber sleeve) is placed over the outside surfaces of interrupter 12 and current exchange 24 before placing plug 100 in the sealing position and before encapsulating interrupter 12 in encapsulation 10. The compliant material 26 extends from the outside surface of current exchange 24 around the bottom of the current exchange and along the interior surface 25 of the current exchange. Thus, compliant material 26 is positioned between the plug 100 and the interior surface 25 of current exchange 24 when the plug is positioned against the current exchange. Compliant material 26 helps to reduce mechanical stresses between interrupter 12 and encapsulation 10 that result from temperature changes and different coefficients of thermal expansion for interrupter 12 and encapsulation 10.

Compliant material 26 may be applied to interrupter 12 and current exchange 24 using a method such as is described in U.S. Pat. No. 5,917,167, which is incorporated by reference. Plug 100 may be placed in a sealing position within the bore of current exchange 24 by bonding or pressing the plug into position. A bonding agent may be applied to at least a portion of interior surface 25 of the current exchange and/or the compliant material 26 covering the interior surface. A bonding agent may also be applied to the external surface 106 of the plug 100. The bonding agent may be a silane-based material, such as, for example, SILQUEST A-1100 (gamma amino propyl triethoxysilane). After the bonding agent has been applied to the interior surface 25 of current exchange 24 and/or the compliant material 26, plug 100 is inserted into internal chamber 14 until flange 108 contacts the compliant material 26 covering the bottom surface of current exchange 24 and the outside surface 106 of the plug contacts the interior surface 25 of current exchange 24 or the compliant material 26 covering the interior surface. The bonding agent then bonds flange 108 of plug 100 to the compliant material covering the bottom surface of the current exchange 24 and bonds the outside surface 106 of the plug to interior surface 25 of current exchange or to the compliant material 26 covering the interior surface 25.

Plug 100 may also be placed in a sealing position by pressing the plug into position without a bonding agent. When a bonding agent is not used, the silicone rubber material of the plug's flange 108 and outside surface 106 may stick to the compliant material 26 and hold the plug in position.

After plug 100 is sealed against current exchange 24, the interrupter 12, the current exchange 24, and the plug 100 are encapsulated in encapsulation 10. A mold is used to create the shape of encapsulation 10 around the interrupter 12, the current exchange 24, and the plug 100. The mold core that forms the operating cavity 15 seals against the inner surface 104 of the plug 100 to prevent epoxy from entering internal chamber 14. Positioning the plug 100 before encapsulation of the interrupter 12 and current exchange 24 eliminates the need for any complex hardware that previously was necessary to seal off internal chamber 14 during encapsulation. This hardware was troublesome in that it tended to leak, which caused the internal chamber 14 to fill with epoxy and prevented the interrupter 12 from actuating. The hardware also had to be removed after the encapsulation process, which required reaching through the operating cavity 15 with other fixturing to unthread and remove components of the hardware.

Previous designs for current exchanges that used older methods of sealing had exposed metal surfaces, often with sharp corners, between the top of the operating cavity 15 and the internal chamber 14 in the current exchange. A high voltage potential on these metal surfaces with sharp corners could cause a high field gradient in air and could thereby lead to potential electric discharges. When plug 100 is sealed against the current exchange 24, the bottom edges and surfaces of the conductive and high voltage current exchange are covered by the compliant, non-conductive material of the plug, thus containing these high field gradients in a solid material more capable of withstanding voltage stress. Also, the plug 100 lengthens the distance between exposed conductive portions of the current exchange 24 and the grounded base 18 of encapsulation 10.

The slight taper to the inner surface 104 of the plug 100 allows the mold for creating the encapsulation to seal easily against the plug 100 and then to be removed easily after the encapsulation 10 has been molded. The mold has a slight taper to mate against the inner surface 104 of the plug while the encapsulation 10 is being molded.

After encapsulation, operating rod 16 is inserted through hole 102 of plug 100 and connected to interrupter 12. The end of the operating rod 16 inserted through the hole 102 may be threaded or have a threaded insert for coupling the rod to a threaded protrusion or indentation of the interrupter 12 and enable actuation of the interrupter by the rod.

A number of implementations have been described. Nevertheless, it will be understood that various modifications may be made. Other implementations are within the scope of the following claims.

What is claimed is:

1. A switchgear assembly comprising:

a vacuum interrupter assembly;

a conductive, elongated current exchange located external to the vacuum interrupter assembly and in electrical contact with the vacuum interrupter assembly, the current exchange defining an elongated internal chamber within the current exchange, the elongated internal chamber having a first end located proximally to the vacuum interrupter assembly and a second end located distally to the vacuum interrupter assembly;

a plug of non-conductive, compliant material positioned at the second end of the internal chamber and having a first portion that extends into the second end of the internal chamber and that is positioned against the current exchange; and an insulative encapsulation surrounding the vacuum interrupter assembly, the current exchange, and the plug.

2. The switchgear assembly of claim 1 wherein the plug further comprises a second portion that is positioned at the second end of the internal chamber, outside the internal chamber and against the current exchange.

3. The switchgear assembly of claim 1 wherein the non-conductive compliant material comprises rubber.

4. The switchgear assembly of claim 1 further comprising a shaft for moving a component of the vacuum interrupter assembly.

5. The switchgear assembly of claim 4 wherein the plug defines a hole through the plug;

a portion of the shaft is located in the internal chamber; and the shaft passes through the hole in the plug.

6. The switchgear assembly of claim 5 wherein at least a portion of the plug is located between the shaft and the current exchange.

7. The switchgear assembly of claim 5 wherein the hole in the plug has a cross-sectional area larger than the cross-sectional area of a portion of the shaft that passes through the hole such that the shaft does not contact the plug.

8. The switchgear assembly of claim 1, wherein the plug defines a hole through the plug.

9. The switchgear assembly of claim 8, wherein the hole through the plug is tapered from one side of the plug to another side of the plug.

* * * * *